US009016225B1

(12) United States Patent
Jenkins

(10) Patent No.: US 9,016,225 B1
(45) Date of Patent: Apr. 28, 2015

(54) APPARATUS, SYSTEM, AND METHOD FOR KAYAK ANCHOR STAKE

(71) Applicant: Robert E. Jenkins, Austin, TX (US)

(72) Inventor: Robert E. Jenkins, Austin, TX (US)

( * ) Notice: Subject to any disclaimer, the term of this patent is extended or adjusted under 35 U.S.C. 154(b) by 161 days.

(21) Appl. No.: 13/664,381

(22) Filed: Oct. 30, 2012

Related U.S. Application Data

(60) Provisional application No. 61/628,660, filed on Nov. 4, 2011.

(51) Int. Cl.

| | |
|---|---|
| ***B63B 21/22*** | (2006.01) |
| ***B63B 21/24*** | (2006.01) |
| ***B63B 21/26*** | (2006.01) |
| ***B63B 21/30*** | (2006.01) |
| *E02D 5/80* | (2006.01) |

(52) U.S. Cl.
CPC ..... *B63B 21/24* (2013.01); *B63B 21/22* (2013.01); *B63B 21/26* (2013.01); *B63B 21/30* (2013.01); *B63B 21/227* (2013.01); *E02D 5/80* (2013.01)

(58) Field of Classification Search
CPC ..... B63B 21/22; B63B 21/227; B63B 21/24; B63B 21/243; B63B 21/26; B63B 21/30; B63B 21/46; B63B 21/50; B63B 2035/71; B63B 2035/715; B63B 2739/00; E02D 5/80
USPC ..... 114/210, 221 R, 230.1, 230.13, 114/293–295, 343, 347; 52/155, 156, 158, 52/159, 165
See application file for complete search history.

(56) References Cited

U.S. PATENT DOCUMENTS

| | | | | |
|---|---|---|---|---|
| 1,120,041 | A * | 12/1914 | Dunn | 119/790 |
| 3,638,257 | A * | 2/1972 | Ernst | 114/351 |
| 6,220,197 | B1 * | 4/2001 | Pohlman | 114/294 |
| 6,766,770 | B1 * | 7/2004 | Voorhees | 119/786 |
| 7,270,072 | B2 * | 9/2007 | Waldrop | 114/295 |
| 7,270,073 | B1 * | 9/2007 | Waldrop | 114/295 |
| 7,827,927 | B2 * | 11/2010 | Kivi | 114/294 |
| 7,861,661 | B2 | 1/2011 | Beaty | |
| 7,921,794 | B1 * | 4/2011 | Cullom et al. | 114/294 |
| 8,051,789 | B1 * | 11/2011 | Tylisz | 114/230.1 |
| 8,661,999 | B2 * | 3/2014 | Blom | 114/230.13 |

* cited by examiner

*Primary Examiner* — Ajay Vasudeva
(74) *Attorney, Agent, or Firm* — Rick B. Yeager

(57) ABSTRACT

A kayak mooring stake is positioned in a scupper hole or sleeve. A knob is provided on the stake, and the knob rests on a shelf or ledge around the inside surface of the scupper hole or sleeve. When the mooring stake is rotated, the knob is positioned over an essentially vertical slot interrupting the ledge or shelf, and the stake can be thrust through the scupper hole or sleeve into the mud/sand at the bottom of a bay, lake, stream or the like, thereby fixing the position of a small watercraft against wind and/or current.

20 Claims, 8 Drawing Sheets

APPARATUS, SYSTEM, AND METHOD FOR KAYAK ANCHOR STAKE

RELATED APPLICATIONS

This non-provisional patent application claims priority of the Nov. 4, 2011 filing date of U.S. Provisional Patent Application No. 61/628,660 by applicant.

BACKGROUND OF THE INVENTION

1. Field of the Invention

This invention relates to a pole anchoring system for kayak or other small watercraft, the apparatus and method of operation thereof.

2. Prior Art

Fishing in shallow water from small boats and kayaks often requires holding one's position against wind and current. This can be done by using some form of propulsion, (motor, paddle or the like against wind/current); lowering an anchor; or manually or hydraulically pushing a stake-out rod into the mud/sand bottom of the lake, river, or bay, etc. and securing the boat thereto. It is generally desirable to fix this position quickly and quietly, so whenever possible, such as when the water is not too deep or the bottom is not too hard, pressing the stake into the bottom is usually the method of choice.

Many small shallow water boats and sit-on-top kayaks have scupper holes that penetrate the hull from deck to bottom such that water can drain therethrough. It is not uncommon to thread a stake-out rod through one of these scupper holes then into the sand or mud in order to secure the boat's position, however, unless special provisions are employed, conventional rotational molding processes leave the scupper holes as the most fragile portions of the kayak hull. In the restricted confines of a kayak, it is also very difficult to quickly and easily line up the stake out rod with the scupper hole in order to pass that rod through to the lake/bay/river bottom, and it is generally a nuisance having the unwieldy rod lashed to the kayak gunnels or otherwise inconveniently stowed when it is not in use, as it becomes "just something else on which to snag a line, a net, or a lanyard."

SUMMARY OF THE INVENTION

A stake-out pole is partially inserted and supported in a substantially vertical raised position in a kayak's scupper hole. In order to anchor the vessel, the stake-out pole is thrust through the scupper hole into the bay/river/lake bottom to provide a quick, quiet, and convenient way to anchor a small vessel in shallow water.

In one embodiment, a kayak mooring stake is positioned in a scupper hole or sleeve. A knob is provided on the stake, and the knob rests on a shelf or ledge around the inside surface of the scupper hole or sleeve. When the mooring stake is rotated, the knob is positioned over an essentially vertical slot interrupting the ledge or shelf, and the stake can be thrust through the scupper hole or sleeve into the mud/sand at the bottom of a bay, lake, stream or the like, thereby fixing the position of a small watercraft against wind and/or current.

It is the object of the present invention to provide means whereby an anchoring device can be easily and conveniently carried in a small water craft where it is out of the way, yet where it will still be quickly available for rapid, silent, and simple deployment to fix the vessel's position in shallow water.

DETAILED DESCRIPTION OF EMBODIMENT

In one embodiment of the current invention, a stake-out pole is retained in a raised position by supporting a pole retention element in a scupper hole or sleeve. The pole is lowered to an anchoring position by rotating the pole to align the pole retention element with a vertical slot in the scupper hole or sleeve.

This unique configuration allows the stake-out pole to be conveniently carried in the scupper hole or sleeve, high above the bottom of the lake, river, bay etc. while the vessel is under way, then, when the occasion arises, the pole can be very quickly and very quietly twisted into the mud/sand of the bottom.

Pole

Figure 1A:
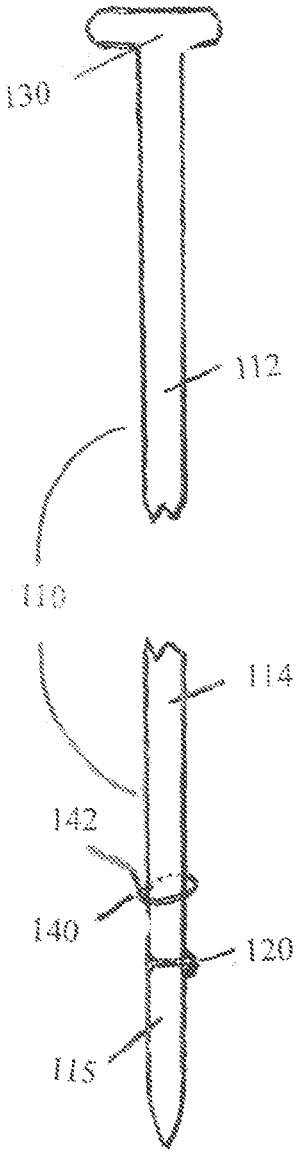
FIG. 1A is a side view of a stake-out pole with a "T" handle.

FIG. 1A is a side view of a typical stake-out pole 110 showing an upper portion 112 and a lower portion 114 which includes a pointed tip 115 with a "T-shape" handle 130. In this example, the pole does not break down for storage.

The pole can be constructed of PVC, fiberglass, wood, carbon fiber, aluminum, or combinations of these materials or of some other material which is suitable for anchoring a kayak or other small boat.

The pole includes a pole support element which retains the pole in a raised, non-anchoring position within a scupper hole or sleeve as discussed below. In this example, the pole support element is a knob 120 which may be constructed of a flat headed machine screw through the shaft, a spacer, and a nut serving as the pole support element. The knob is positioned in the lower portion of the pole.

The pole support element, such as a knob 120, a spring loaded catch as described below, or other structure located on the side of a lower portion of the pole is sized to fit and slide within a vertical slot of a sleeve or scupper such that as the pole is lifted so that the pole support element is raised and partially rotated above a ledge or other support feature, the knob can rest on the ledge, thereby holding the pole in a raised position. Following another partial twist, the knob can be thrust downward through the slot, thereby allowing the pole to be thrust down into the mud/sand of a bay or river bottom to anchor the kayak or other small boat.

A ring 140 is shown encircling the shaft of the pole. It is large enough to slide freely along the shaft, but small enough so as not to clear the handle 130 at the upper end of the shaft, nor the knob 120, at the lower end of the shaft. In this example, the ring is constructed of stainless steel or other suitable material and is provided on the shaft of the stake out pole between the handle and the pole support element. A lanyard or anchor rope 142 can be attached to the sliding ring.

The ring 140, even with its lanyard attached to the vessel, freely slides up and down the anchor pole shaft from knob to handle. It is securely attached to the pole, but does not restrict the movement of the pole upward or downward, and therefore does not alter the use of the pole in the scupper or sleeve, yet attaches the valuable pole in a secure fashion to the vessel, limiting the pole's loss overboard. In water too deep to anchor with the stake through the scupper, an anchoring rode can be attached to the ring and the pole thrust over the side and pressed into the bay/river/lake bottom. The ring falls to the bottom of the pole just above the water's bottom, providing the best possible leverage point for the anchor rode to attach. Pulling straight up on the rode, causes the ring to again rise to the handle, where the stake can then be easily retrieved.

Figure 1B:
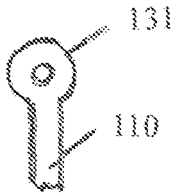
FIG. 1B is a side view of an alternate handle shape for stake-out pole of FIG. 1A.

FIG. 1B shows a "circular" shaped handle 131 on the pole 110.

Figure 1C:
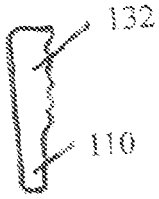
FIG. 1C is a side view of an alternate handle shape for stake-out pole of FIG. 1A.

FIG. 1C shows a straight handle 132, another of the many acceptable handle shapes.

Pole Support Element

Figure 2A:
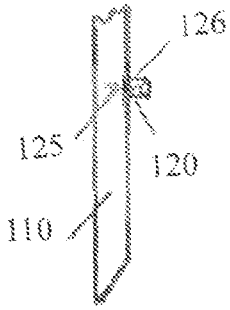
FIG. 2A is a side view of the lower end of a stakeout pole with a fixed knob.

FIG. 2A shows a stakeout pole 110, where a knob 120 is fixed. In this example, the knob is constructed of a screw 125, a spacer 126, and a nut. The nut serves as the pole support element.

Figure 2B:
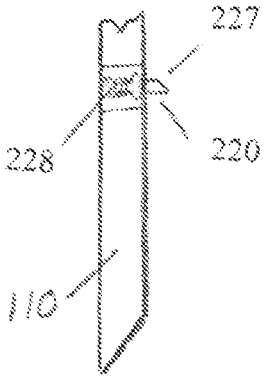
FIG. 2B is a side view of the lower end of a stakeout pole with a retractable and spring loaded pole support element.

FIG. 2B shows a stakeout pole where a spring-loaded pin 220 is retractable into the shaft and shaped with an upwardly-facing angled face 227 such that it automatically retracts into the pole shaft when the pole 110 is lifted into the scupper hole or sleeve. Beyond the confines of the scupper hole or sleeve, a spring 228 returns the pin 220 to its original position.

Sectional Pole

Figure 3A:
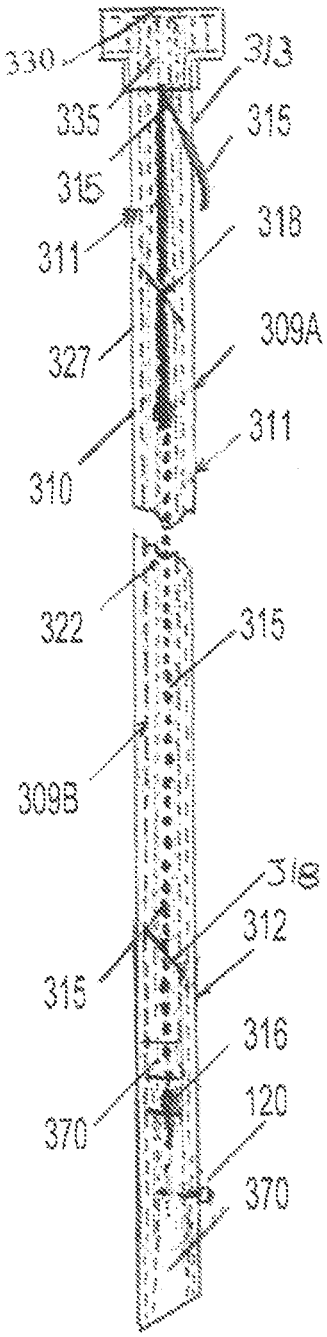
FIG. 3A is a side cross section view of an assembled sectional stake-out pole.
Figure 3B:
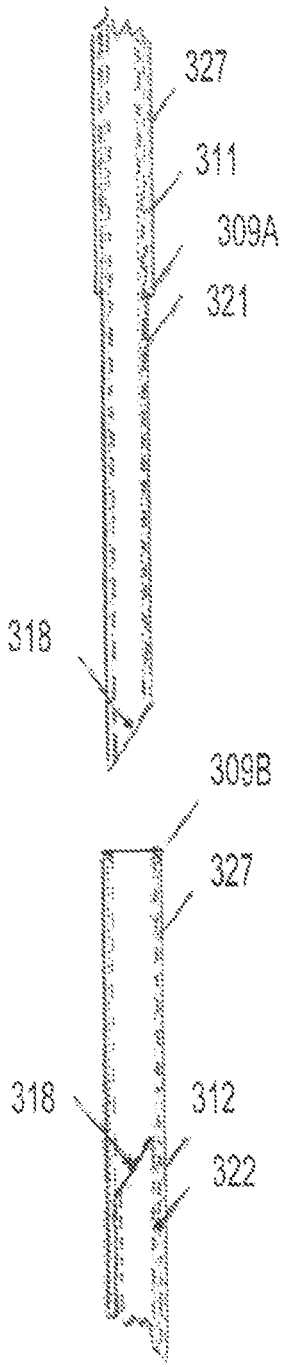
FIG. 3B is a detailed cross section exploded side view of a joint in the sectional stake-out pole of FIG. 3A.
Figure 3C:
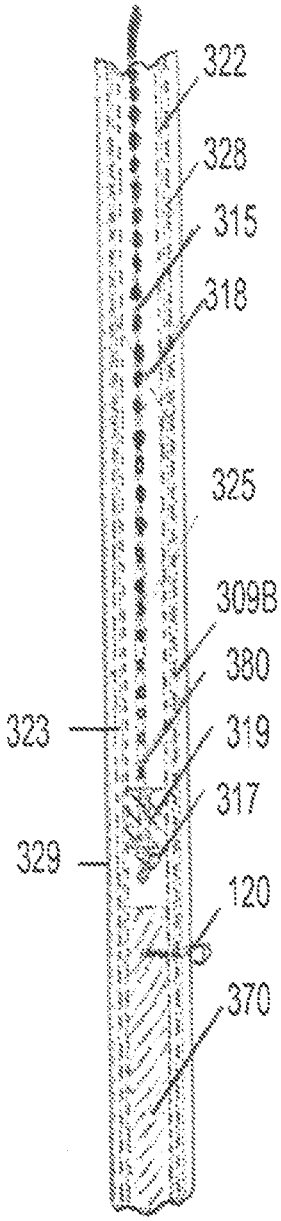
FIG. 3C is a detailed cross section side view of the lower section of the stake-out pole of FIG. 3A

FIGS. 3A-3C show a stake out pole/stake/rod 310 constructed in separate sections 311, 312, and 313. The sections are joined at junctions 309A and 309B. The sections telescope or slide inside each other to form the assembled pole allowing the pole to be broken down for easy storage. In this example, each section comprises an inside tube 321, 322, and 323 cemented inside an outside tube 327, 328, and 329, such that the inner tube protrudes beyond one end of the outer tube and can then be inserted into the outer tube of the adjacent section. The sections are joined at joints 319A and 319B.

A rope 315 and/or elastic cord 380 is firmly attached inside the lowest section with a retaining knot 316, or otherwise attached, then runs upward and inside all the sections to exit through the top of the topmost section. In some examples, a junction 325 is provided between an elastic cord and a rope.

Pulling the rope 315 firmly upward through all the sections, and locking a second knot 317 in the rope into a notch 335 in the top section tubing 311 forces the angled ends 318 of the inner tubes firmly together, thereby locking the sections together in a rigid unit. The lowest portion of the lower section may be solid, filled with a dowel 370 made of plastic or wood, or other suitable substance, whereby mud and debris from the bottom of the lake, bay etc. cannot collect therein. In this example, the knob 120 is attached into that solid portion of the lowest section.

FIG. 3B is a detailed cross section side view of a joint in the sectional stake-out pole of FIG. 3A.

FIG. 3C is a detailed cross section side view of one embodiment of a removable rope-retaining handle of the lower section of the stake-out pole of FIG. 3A.

Figure 3D:
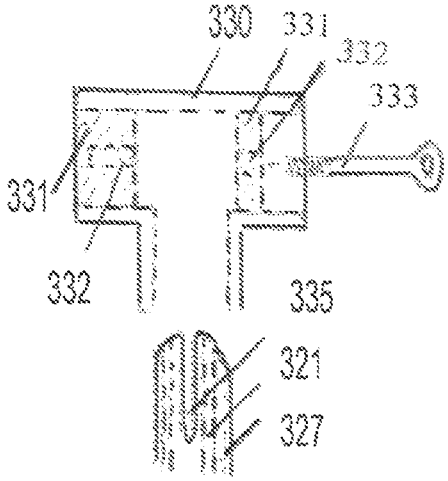
FIG. 3D is a detailed cross section side view of the removable rope-retaining handle of the sectional stake-out pole of FIG. 3A.

FIG. 3D is a detailed cross section side view of the removable rope-retaining handle of the sectional stake-out pole of FIG. 3A. In FIG. 3D, each end of a hollow handle 330 is shown filled with a plug 331 made of wood or plastic or other suitable material, which plugs are perforated by a hole 332. The hole may be threaded, and permits a pin 333, such as a threaded eye bolt to be inserted to removably fasten the handle 330 to the upper end of the upper stake-out pole tubing section 311.

Figure 3E:
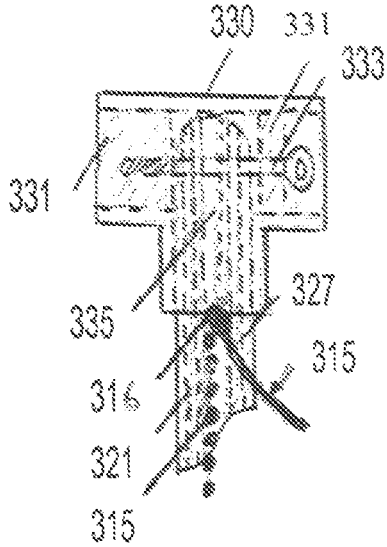
FIG. 3E is a detailed cross section side view of the assembled rope-retaining handle of the sectional stake-out pole of FIGS. 3A-3D.

FIG. 3E is a detailed cross section side view of the assembled rope-retaining handle of the sectional stake-out pole of FIGS. 3A-3D. In this example, the long notch 335 in the top of the stake-out tubing extends further down the tubing than does the handle 330, providing space for the rope 315 when it is locked into the notch 335 by knot 316 thereby locking the rope in the notch, until the handle is removed.

Typical Kayak

Figure 4:
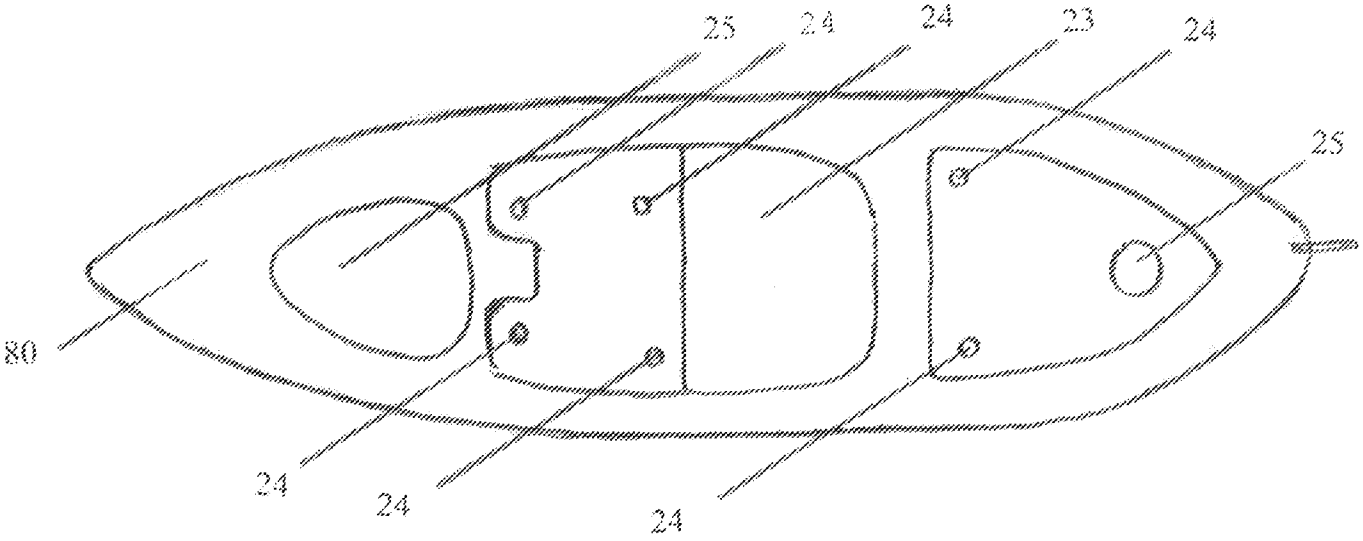
FIG. 4 is a top view of a typical kayak showing the kayak seat, scupper holes, and hatches.

FIG. 4 is a top view of a typical kayak 80 showing a typical kayak seat area 23; six typical scupper holes 24; and three typical hatches 25.

Figure 5:
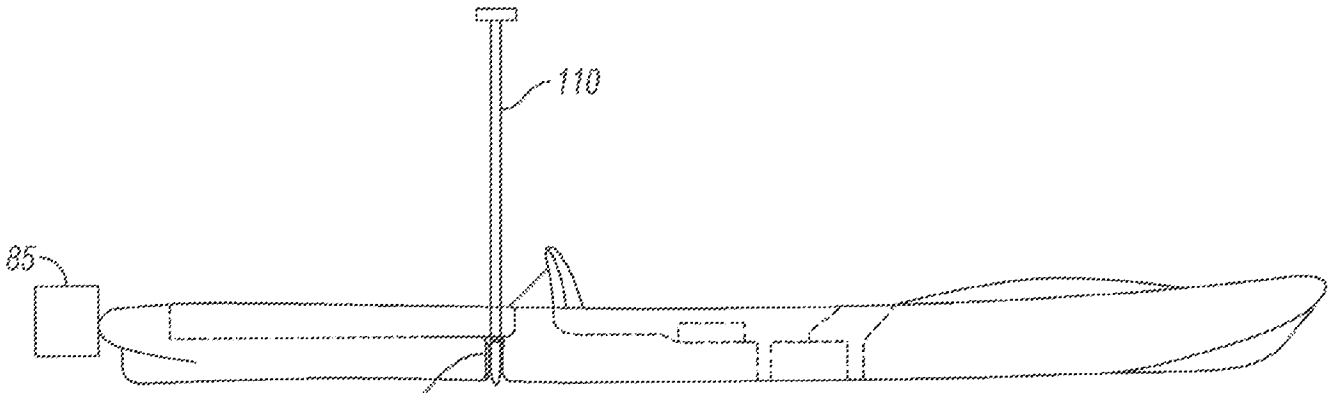
FIG. 5 is a side view of a typical kayak showing a stake-out pole being transported in one of the scupper holes, according to an embodiment of the invention.

FIG. 5 is a side view of a typical kayak 80 showing a stake-out pole 110 being transported in one of the scupper holes 24, according to an embodiment of the invention.

Scupper Hole

In one embodiment of the current invention, a scupper hole 24 is constructed so as to be slightly larger than the stake-out pole 110 such that the pole can easily telescope down through the hole. Inside and around the scupper hole close to its upper rim, a horizontal ledge 26 of sufficient width as to engage a small knob 120 which has been placed on the side of the stake-out pole close to the pole's lower end. In other embodiments, a sleeve is inserted into the scupper hole as discussed below.

The knob is captured by the ledge such that the pole cannot penetrate further; thus holding the pole high above the bottom of the body of water. Contiguous with the ledge is a vertical slot 27 in the inner wall of the scupper hole which slot is slightly wider than the knob on the stake. Twisting the pole 110 so that the knob 120 enters the slot 27 allows the knob and pole to drop through the scupper hole and down to the bottom. A bit of additional twisting downward pressure forces the pole into the (lake, bay, river) bottom to anchor the boat.

Figure 6:
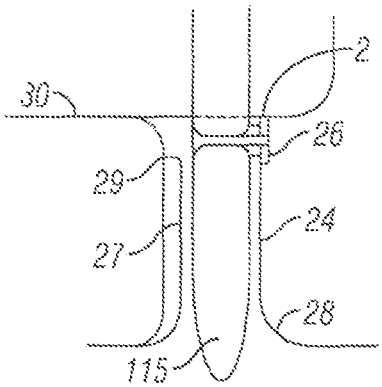
FIG. 6 a side view cross section view cut through the scupper hole of FIG. 5, enlarged and enhanced to show a detail of the scupper hole and showing a portion the stake-out pole, as it is carried in the scupper hole according to an embodiment of the invention.

FIG. 6 a side view cross section view cut through the scupper hole of FIG. 5, enlarged and enhanced to show a detail of the scupper hole and showing a portion of the stake-out pole, as it is carried in the scupper hole according to an embodiment of the invention. FIG. 6 shows a scupper hole 24; a lower part of the stakeout pole 110; a retaining ledge 26; a knob 120 on the pole 110; the slot 27; a flared lower entry 28 to the slot; and small "humps" 29 in the ledge at either side of the slot.

Disengaging the pole 110 from the mud/sand requires only lifting the stake-out pole, twisting it to realign the knob 120 with the slot 27, pulling it up through the scupper hole 24, again twisting the pole when the knob 120 is above the ledge 26 allowing said knob to rest anew on the horizontal ledge 26. The bottom opening of the slot 27 may be flared 28 to facilitate raising knob 120 back through the slot.

Small humps 29 in the horizontal ledge 26 on either side of the vertical slot 27 provide small barriers the knob must clear in order to reach said slot, making sure the pole 110 cannot vibrate around and release inadvertently while under way.

Figure 7:
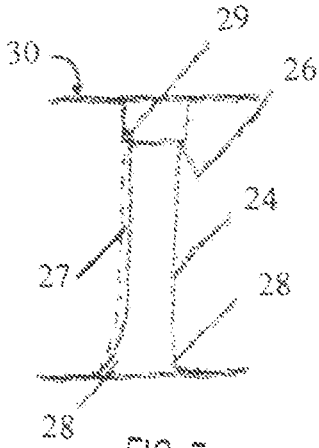
FIG. 7 is another enlarged and enhanced side view section cut through the scupper hole of FIG. 5, without the pole, showing details of the internal anatomy of the scupper hole, according to the embodiment of the invention.
Figure 8:
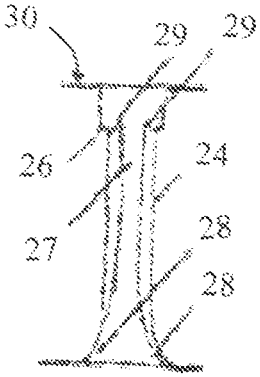
FIG. 8 is an enlarged and enhanced cross section view cut through the scupper hole of FIG. 5, without the pole, showing details of the scupper hole, according to the embodiment of the invention.
Figure 9:
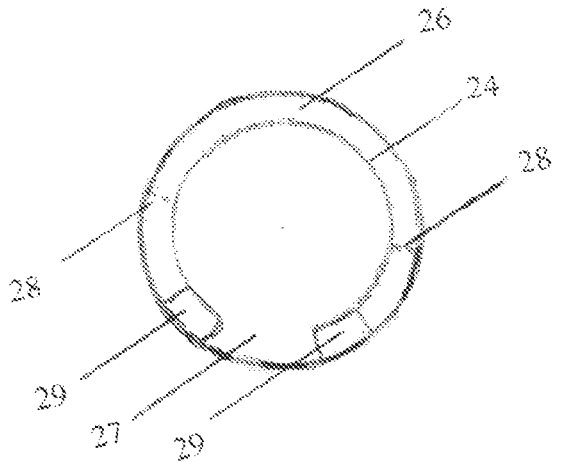
FIG. 9 is an enlarged and enhanced top view of the scupper hole of FIG. 5 showing details of the internal anatomy of the scupper hole, according to an embodiment of the invention.

FIG. 7, FIG. 8, and FIG. 9 all show different views of a scupper hole 24; a knob retaining ledge 26; a slot 27; a flared lower entry 28 to the scupper hole and slot; and small humps 29 in the horizontal ledge on either side of the slot). The deck of the kayak is numbered 30.

FIG. 7 is another enlarged and enhanced side view section cut through the scupper hole of FIG. 5, without the pole, showing details of the internal anatomy of the scupper hole, according to an embodiment of the invention.

Disengaging the pole 110 from the mud/sand requires only lifting the stake-out pole, twisting it to realign the knob 120 with the slot 27, pulling it up through the scupper hole 24, again twisting the pole when the knob 120 is above the ledge 26 allowing said knob to rest anew on the horizontal ledge 26. The bottom opening of the slot 27 may be flared 28 to facilitate raising knob 120 back through the slot.

FIG. 8 is an enlarged and enhanced cross section view cut through the scupper hole of FIG. 5, without the pole, showing details of the scupper hole, according to an embodiment of the invention.

FIG. 9 is an enlarged and enhanced top view of the scupper hole of FIG. 5 showing details of the internal anatomy of the scupper hole, according to an embodiment of the invention.

Sleeve

Figure 10:
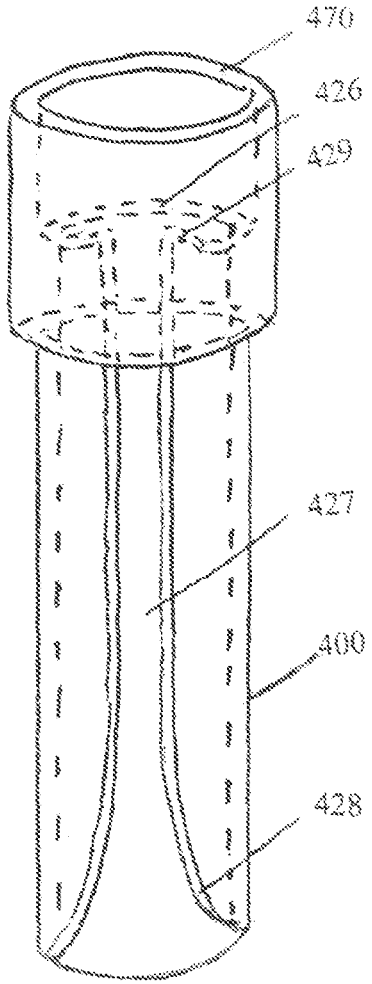
FIG. 10 is a perspective view of one version of a sleeve which can be inserted into a scupper hole, to modify the internal shape of that hole so that it conforms to the embodiments of this invention, or which can be attached via a bracket to the gunwale or transom of a vessel.
Figure 11:
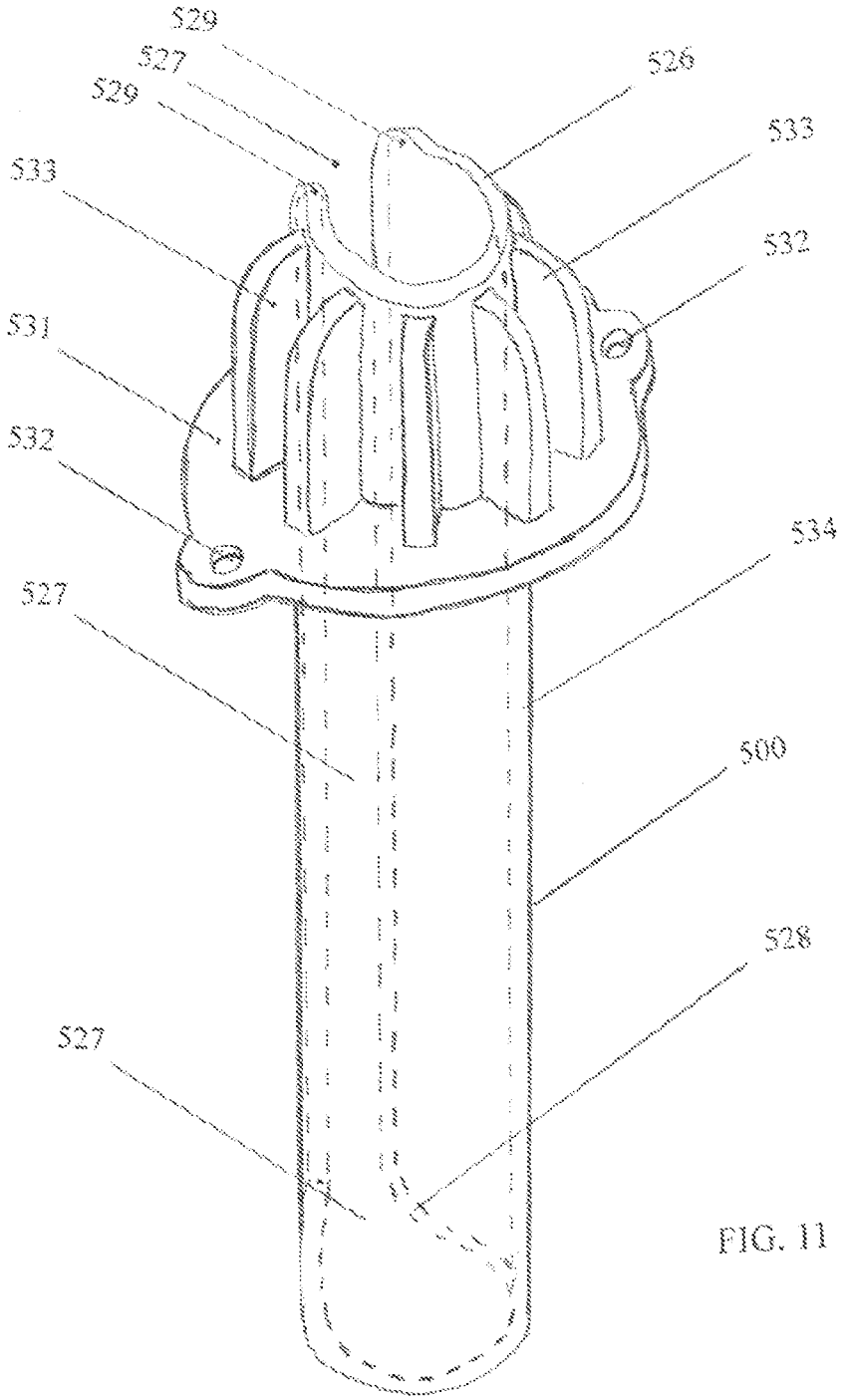
FIG. 11 is a perspective view of a second version of a sleeve which can be secured into a scupper hole to modify the internal shape of that hole to conform to the embodiments of this invention, or which can be attached via a bracket mounted to the gunwale or transom of a vessel.

An alternative embodiment of the invention is shown in FIGS. 10 and 11. In this embodiment, a fixed or removable sleeve is inserted into a standard scupper hole will temporarily or permanently reinforce that scupper hole and will modify its internal shape so as to function as is described in the paragraphs above. In other examples, the sleeve may be attached to the gunwale or transom of a vessel with a bracket 85 such as shown in FIG. 5, such that it will provide those same functions.

FIG. 10 is a perspective view of one version of a sleeve which can be inserted into a scupper hole, to modify the internal shape of that hole so that it conforms to the embodiments of this invention, or which can be attached via a bracket to the gunwale or transom of a vessel. In this example, the features of the sleeve 400 are similar to those of the scupper hole described above with a ledge 426; a slot 427; the flaring of the slot's lower opening 428; and the humps 429 on either side of the slot. The upper end of the sleeve may be encased in a confining collar 470.

FIG. 11 shows a perspective view of a second molded version of a sleeve 500 which can be secured into a scupper hole to modify the internal shape of that hole to conform to the embodiments of this invention, or which can be attached via a bracket mounted to the vessel's gunwale or transom. FIG. 11 shows the ledge 526 the slot 527; the flaring of the slot's lower opening 528; and the humps 529 on either side of the slot 527; mounting flange 531 and mounting holes 532; and fins 533 which reinforce the upper part of the sleeve barrel 534 and the flange 531.

In another embodiment, one or more sleeves made of metal or other suitable materials may be inserted in scupper holes during a molding process, and remain fixed in the scupper hole for reinforcement. The sleeve may have slot features as described above, or may be provided without a slot and used in conjunction with an anchor pole that has a retractable or removable pole support element.

In another embodiment, a sleeve without a slot feature may be removably inserted or affixed in a scupper hole and used in conjunction with an anchor pole that has a retractable or removable pole support element.

In another embodiment, a sleeve is used to reinforce a scupper hole and permit insertion of an anchor pole which does not have a pole support element.

Operation

A stake out pole has a pole support element, such as a fixed knob or a retractable pin. When the pole support element rests on the ledge 26, the stake out pole is supported in a raised position. When the stake out pole is rotated the pole support element may be oriented above the slot 27 so that the pole support element may slide within the slot 27 so that the stake out pole may be dropped or pushed into an anchoring position.

When the stake out pole is raised, the flared lower opening 28 provides a guide to rotate the pole and pole support element until the pole support element is raised above the ledge 26.

In other examples, the sleeve may be attached with a bracket or other support means, to other parts of the vessel, such as to the gunwale or transom of a vessel.

While an exemplary embodiments of the invention have been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A kayak anchoring system for a kayak or other vessel, the anchoring system comprising
a sleeve supported by the vessel, the sleeve comprising
an upper portion,
a lower portion,
an internal surface,
a substantially circumferential ledge on the internal surface of the upper portion of the sleeve,
a vertical slot in the internal surface, the vertical slot extending from the circumferential ledge through the lower portion of the sleeve; and
an anchoring pole comprising
a lower end,
a handle end, and
a pole support element, such that the anchoring pole is supported in a raised position when the pole support element rests on the ledge, and the anchoring pole is lowered to an anchoring position by rotating the pole support element to align with the vertical slot and dropping or downwardly thrusting the anchoring shaft through the sleeve.

2. The kayak anchoring system of claim 1 wherein
the sleeve is removable, and further comprises a collar, such that the collar supports the sleeve in a scupper hole or bracket.

3. The kayak anchoring system of claim 2 wherein
the kayak or other vessel further comprises a scupper hole; and
the collar is supported by a top portion of the scupper hole.

4. The kayak anchoring system of claim 2 wherein
the kayak or other vessel further comprises a sleeve bracket.

5. The kayak anchoring system of claim 1 wherein
the pole support element is a fixed knob.

6. The kayak anchoring system of claim 1 wherein
the pole support element is a retractable pin.

7. The kayak anchoring system of claim 1 wherein
the shaft is a single section of rod, pipe or tubing.

8. The kayak anchoring system of claim 7 further comprising
a sliding ring placed around a lower portion of the pole; and
a rope having a first end attached to the ring and a second end placed in or attached to the kayak, such that when the second end of the rope is pulled the ring slides to the handle so that the handle and pole can pulled upward.

9. The kayak anchoring system of claim 1 further comprising
a multi-sectional shaft comprising
a top pole section, and
a bottom pole section.

10. The kayak anchoring system of claim 9 further comprising
a slot in the top pole section; and
a rope or elastic cord having a first end affixed to the bottom pole section and a second end with a knot, such that the knot can be retained in the slot in order to hold the top section relative to the bottom section when the pole is assembled.

11. The kayak anchoring system of claim 9 further comprising
one or more middle pole section.

12. The kayak anchoring system of claim 1 wherein
the bottom of the vertical slot is flared.

13. A kayak anchoring system comprising
a kayak comprising
a scupper hole comprising
an upper portion,
a lower portion,
an internal surface,
a substantially circumferential ledge on the internal surface of the upper portion of the scupper hole,
a vertical slot in the internal surface, the vertical slot extending from the circumferential ledge through the lower portion of the scupper hole;
an anchoring shaft comprising
a lower end,
a handle end, and
a pole support element, such that the anchoring shaft is supported in a raised position when the pole support element rests on the ledge, and the anchoring shaft is lowered to an anchoring position by rotating the pole support element to align with the vertical slot and dropping or downwardly thrusting the anchoring shaft through the scupper hole.

14. The kayak anchoring system of claim 13 wherein
the pole support element is a fixed knob.

15. The kayak anchoring system of claim 13 wherein
the pole support element is a retractable pin.

16. The kayak anchoring system of claim 13 wherein
the shaft is a single section of rod, pipe or tubing.

17. The kayak anchoring system of claim 16 further comprising
a sliding ring placed around a lower portion of the pole; and
a rope having a first end attached to the ring and a second end placed in the kayak, such that when the second end of the rope is pulled the ring slides to the handle so that the handle and pole can pulled upward.

18. The kayak anchoring system of claim 13 further comprising
a multi-sectional shaft comprising
a top pole section, and
a bottom pole section.

19. The kayak anchoring system of claim 18 further comprising
a slot in the top pole section; and
a rope or elastic cord having a first end affixed to the bottom pole section and a second end with a knot, such that the knot can be retained in the slot in order to hold the top section relative to the bottom section when the pole is assembled.

20. The kayak anchoring system of claim 13 wherein
the bottom of the vertical slot is flared.

* * * * *